United States Patent [19]

Gooden

[11] Patent Number: 4,964,500

[45] Date of Patent: Oct. 23, 1990

[54] TABACCO PROCESSING PNEUMATIC ALIGNMENT METHOD AND APPARATUS

[76] Inventor: Eldon Gooden, Rte. 1, Box 1500, Quinton, Va. 23141

[21] Appl. No.: 387,812

[22] Filed: Aug. 1, 1989

[51] Int. Cl.[5] ..... B65G 47/24

[52] U.S. Cl. ..... 198/380; 198/382; 198/689.1; 131/110

[58] Field of Search ..... 198/380, 392, 689.1; 131/110

[56] References Cited

U.S. PATENT DOCUMENTS

| | | | |
|---|---|---|---|
| 1,832,119 | 11/1931 | Hohn et al. | 131/110 |
| 3,439,793 | 4/1969 | Rakestraw | 198/380 |
| 3,623,595 | 11/1971 | Brown et al. | 198/380 |

*Primary Examiner*—Joseph E. Valenza

*Attorney, Agent, or Firm*—Cushman, Darby & Cushman

[57] ABSTRACT

A conveyor system for automatically orienting a majority of tobacco leaves received thereby in a lengthwise direction so that their stems are substantilly parallel to a final direction of conveyance. Tobacco leaves to be oriented are delivered by means of a high speed belt to a pneumatic processing apparatus in the form of a rotary screen assembly. The rotary screen assembly includes a broad perforated or open meshed screen which is driven in a downward and preferably vertical direction at its front side. The rotary screen is mounted adjacent and operatively coupled to a device for generating an air current through the screen such that the air holds articles to be oriented on the front side of the screen while being conveyed thereby. A take-off conveyor is mounted vertically below the rotary screen for receiving articles therefrom. As the articles are transferred from the rotary screen to the take-off conveyor they are laid on the take-off conveyor so as to be substantially parallel to the direction of conveyance of the take-off conveyor.

33 Claims, 6 Drawing Sheets

TABACCO PROCESSING PNEUMATIC ALIGNMENT METHOD AND APPARATUS

BACKGROUND OF THE INVENTION

1. Field of the Invention

The present invention relates to a method and apparatus for processing leaf tobacco and, in particular, to a process and apparatus for aligning tobacco leaves to facilitate the further processing of the same such as the removal of the lamina from the objectionable stem portion of the leaf or cutting across the width of the leaves for those markets that require small segments of the stem, sometimes called "Birds Eyes", to remain in the finished product.

2. Description of the Related Art

Tobacco grown throughout the world is marketed and received at processing plants in many varying sizes and types of bulk packages, such as sheets, tersa bales, farmers bales, etc. At processing plants, these bulk packages go through preparational processing to facilitate the break down of the packages into generally loose leaf form to facilitate uniform conveyance to further processing stations.

In recent years, the efforts of the cigarette tobacco industry have been directed toward achieving a larger lamina particle size. Indeed, the larger the lamina particle size, the more cigarettes can be produced from a pound of tobacco. This is known as "filling power". Hence larger particles translate to more cigarettes produced and hence increased revenues from the same poundage of tobacco.

The addition of heat and moisture, for example, permits the break down of the packages into loose leaf form with a minimum degradation of the leaves. Indeed, tobacco pliability depends on temperature, as well as moisture. For example, tobacco leaves with 14 percent moisture by weight at ambient temperature or lower tend to be brittle and will break and shatter when handled. On the other hand, when the temperature is increased substantially, the leaves become very supple and pliable. Therefore, the packages of tobacco received at the processing plant may require heat or moisture or both. This will depend on the moisture content and pliability of the tobacco when received.

Accordingly, the bulk packages of tobacco are initially conditioned by heat and/or moisture addition to minimize degradation during the further processing such, as in bulk feeders and rotary laminators which are used to break down the package into relatively loose leaf form. The loose leaves are then conveyed to either a quality color sorting and foreign matter removal processing apparatus or directly to reconditioning rotary cylinders.

The reconditioning rotary cylinders are utilized to increase the moisture of the leaves to a range of 19 to 22 percent and the temperature to a range of 120° to 150° F. The leaves are then fed into a series of thresher and air classifiers to tear and separate lamina or strips from the objectionable stem portion. This step is repeated until virtually all lamina has been removed and separated from the objectional stem portion.

The horsepower requirements for driving the threshers and the fans needed for air classification make the foregoing conventional processing extremely energy intensive. A further disadvantage of this conventional processing technique is that the plural threshing stages required to remove all the lamina from the objectional stem necessarily degrades the lamina particle size. Indeed, the conventional methods of threshing and separation have progressed to the point that little further increase in particle size can be expected. It is, however, desirable to process tobacco in a manner that maximizes the particle size of the finished strip product while removing the objectionable portion of the stem.

SUMMARY OF THE INVENTION

It is an object of the present invention to provide a method and apparatus for processing tobacco which facilitate the removal of the leaf portion or lamina from the stem portion of the tobacco leaf while maintaining the lamina with as large a particle size as possible.

It is a further object of the present invention to reduce energy consumption during tobacco processing as well as maximize the average particle size of the final product by minimizing the amount of tobacco leaf that must be fed through a series of threshers and classifiers.

Thus, it is a further object of the invention to reduce the cost of processing tobacco from whole leaf form to separated lamina or strips and stem form and thereby enable cigarette manufactures to reduce the cost of making cigarettes.

These and other objects of the present invention are realized by providing a conveyor system which automatically orients a majority of the tobacco leaves in a lengthwise direction so that their stems are basically parallel to the final direction of conveyance. In this regard, it is noteworthy that while stem parts extend through the entire tobacco leaf, only about $\frac{2}{3}$ of the main stem, extending from the butt portion of the leaf, is deemed objectionable. Thus, orienting leaves with the apparatus of the invention enables the oriented leaves to be further processed to reliably remove relatively large portions of the lamina from the undesirable stem portions, thereby reducing the proportion of tobacco leaf, if any, which must be fed through threshers and classifiers.

In accordance with the present invention, then, loose tobacco leaves are fed, for example, to a high speed belt which terminates at the top front of a unique pneumatic processing apparatus which may be termed a rotary screen assembly. The rotary screen assembly is comprised of a perforated or open-meshed belt or screen which is driven such that the screen moves in a downward and preferably vertical direction at its front. The rotary screen assembly is mounted adjacent and operatively coupled to a pneumatic means for generating an air current through the screen such that air is directed through the front side of the screen and out of the back side. At the bottom portion of the screen assembly, preferably from 4 to 15 inches above the bottom of the screen there is a substantial reduction or stagnation of air flow through the screen assembly caused by the bottom most roller which supports the screen for rotation. The reduction in air flow can be augmented by providing a baffle or the like adjacent the roller.

The rotary screen assembly is thus mounted such that the tobacco leaves fed thereto are drawn to and held on the surface of the moving portion of the screen by the air flow and carried with the screen until they reach the baffled portion whereupon the air flow becomes insufficient to hold the leaves on the screen. As a result, the leaves drop off the screen and are laid, generally longitudinally, onto a take-off conveyor.

The take-off conveyor may either be a roller conveyor or a belt that intersects the longitudinal axis of the conveyance path of the rotary screen assembly vertically below the bottom portion thereof. Thus, as a leaf reaches the lower, baffled portion of the rotary screen and begins to fall free, a portion of the leaf contacts the take-off conveyor and begins to be drawn along its direction of travel.

The overall effect of the rotary screen assembly, then, is to take the tobacco leaves fed thereto, further separate them one from another, and then lay them on the take-off conveyor such that a great majority of the tobacco leaves are oriented on the conveyor with the stem portion of the leaf generally parallel to the direction of travel. Various guides or wall portions may be placed along the transverse conveyor to assist in orienting the individual tobacco leaves as they fall from the bottom portion of the rotary screen. The rotary screen assembly also serves the function of providing a cleaning step whereby sand, dust, and dirt still present on the tobacco can be drawn through the open mesh of the rotary screen and separated out in an air collection system.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
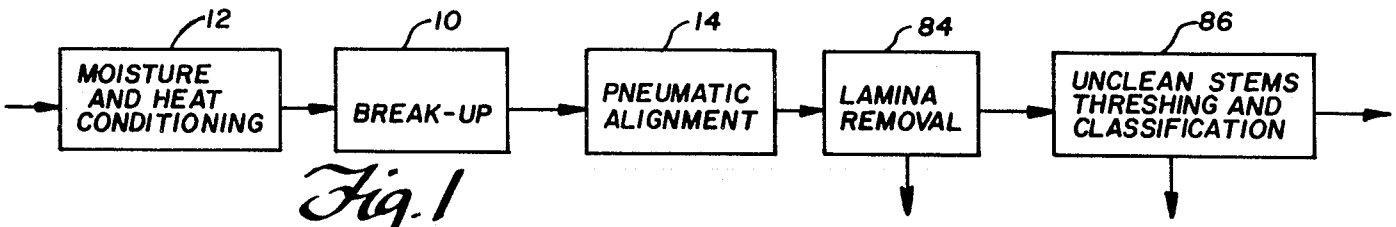
FIG. 1 is a schematic representation of a portion of a tobacco processing plant provided in accordance with the present invention.

Referring to FIG. 1, tobacco arrives at a processing plant in varying shapes and sizes of packages such as sheets, tersa bales, farmers bales, etc. (not shown). The packages are conditioned to desired temperature and moisture content and are then broken up to loose leaf form.

The packages are broken up into smaller chunks and individual leaves by any conventional apparatus, shown generally at 10, and can be broken up before, during, or after conditioning depending upon the form in which the tobacco is received and the conditioning apparatus employed.

The tobacco is also processed to penetrate moisture and heat into the stem portion to make the lamina and stem portion pliable so as to facilitate separation of the lamina from the stem parts and to minimize degradation of the tobacco leaf particle size during subsequent processing. The increase in heat and moisture and heat content can be effected with any conventional apparatus, shown generally at 12. For example, a rotary conditioning drum can be employed. A rotary conditioning drum serves to breakup the chunks into individual leaves. In the alternative, a vacuum chamber can be employed. With such a system, bales are placed in the chamber, a vacuum drawn and the air is then replaced with desuperheated steam. The vacuum enables the desuperheated steam to penetrate rapidly into the bales and into the stem portion of the leaves. After conditioning and breakup, the tobacco leaves are fed to the pneumatic alignment apparatus of the invention, shown generally at 14.

Figure 2:
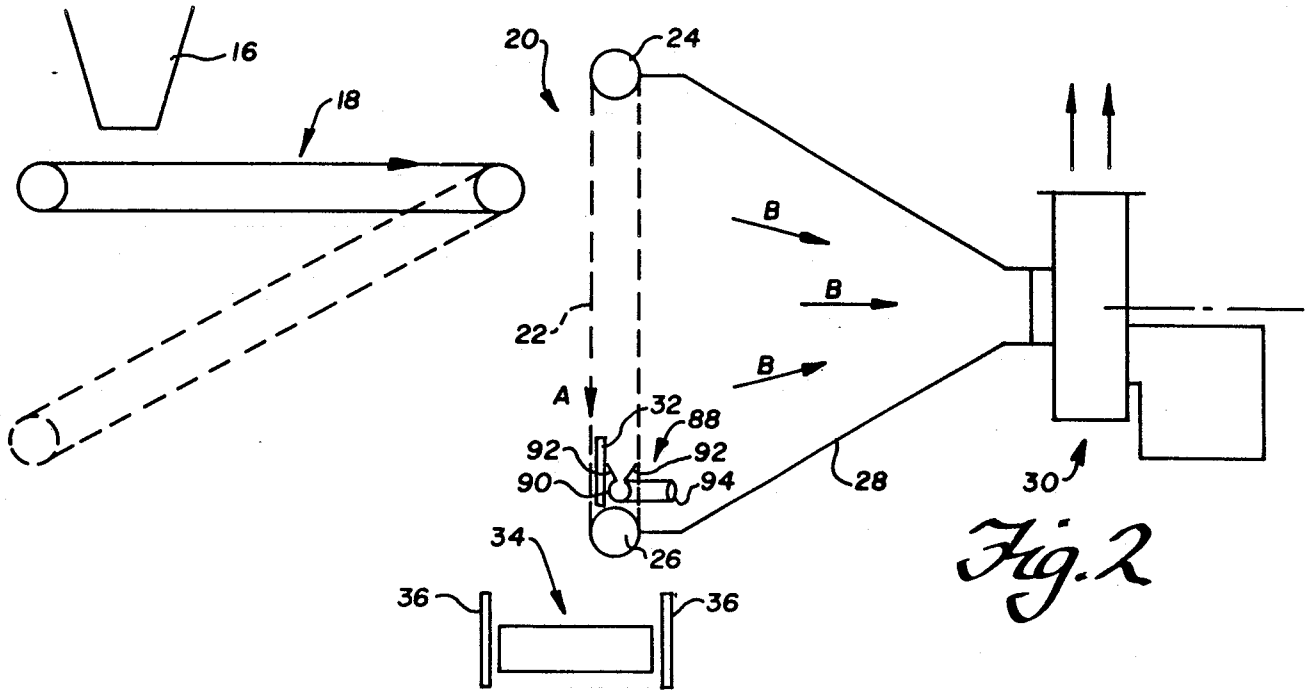
FIG. 2 is a schematic side elevational view of a pneumatic leaf orienting conveyor system provided in accordance with the present invention.

Referring to FIG. 2, one embodiment of the pneumatic alignment apparatus provided in accordance with the present invention is shown. As can be seen, the separated tobacco leaves are dropped through, for example, a chute 16 onto a high speed conveyor 18. The leaves are conveyed towards the right as shown in FIG. 2. The high speed conveyor 18 reduces the depth of conveyed tobacco which in turn stretches out the distance between leaves which increases the possibility of a steady stream of individual tobacco leaves being propelled towards the upper portion of a rotary screen conveyor 20.

The high speed conveyor 18 employed can either be disposed substantially horizontally as shown in solid lines or can be inclined vertically to carry the leaves upwardly towards the rotary screen to adapt the apparatus to existing production lines and in order to accommodate rotary screens of varying heights, as shown in phantom lines. Indeed, the particular orientation of the high speed conveyor 18 is dependent upon the manner in which leaves are delivered thereto and the particular processing plant in which the system of the invention is provided. Further, disposing the high speed conveyor at an angle increases the likelihood that clumps of leaves will tumble and the leaves will separate prior to delivery to the rotary screen. Such an angled configuration would also facilitate the use of electronic grading devices (not shown), also known as optical comparitors which have been replacing manual color grading. The optical comparitors, called electronic graders, accept or reject based on color quality averages over the length of the leaf. The comparitors are calibrated to make this determination from a pre-determined acceptable color quality. If of unacceptable color quality, the leaf is removed from the main stem of quality tobacco by means of a timed jet of air. Optical comparitors could be utilized in the alternative or in addition, at the end of belt conveyors 18 or 34 depending on the installation requirements of the particular facility.

The rotary screen conveyor 20 of the pneumatic alignment apparatus of the invention includes a continuous, perforated belt or open-meshed screen 22 which is driven over at least two parallel rollers 24, 26. In the embodiment illustrated in FIG. 2, the rotary screen is oriented to travel substantially vertically, moving in a downward direction on the side thereof which is in facing relation to or could be perforated rotary cylinder with air being pulled from one or both sealed ends of a rotary cylinder.

The rotary screen 22 is mounted so that the back side thereof substantially covers the opening of a plenum chamber 28 connected to an exhaust blower shown generally at 30. The opening of the plenum chamber 28 is preferably substantially rectangular so as to correspond to the shape of the back side of the rotary screen 22.

The air current generated by the exhaust blower 30 is such that air is drawn through the front side of the rotary screen 22, out the back, and through the plenum chamber 28 as shown by arrows B. Thus, tobacco leaves which are projected towards the front side of the rotary screen 22 by the high speed conveyor 18 are drawn to the screen 22 The leaves are held substantially in place on the rotary screen 22 by the air current therethrough and carried with it to near the bottom of its path of travel. Once each leaf reaches the region of the bottom roller 26 it will begin to be released due to a decrease in air flow caused by the bottommost roller 26 and an optional baffle 32 mounted adjacent thereto, as described more fully below.

In the alternative, the rotary screen conveyor 20 can be in the form of a perforated drum (not shown). In such an embodiment, suction preferably be applied through one or both of the drum end walls so that a current of air is generated from the front side or outer circumferential surface of the conveyor to a back side or inner circumferential surface of the perforated drum. Further, with such an embodiment, a vacuum shoe or the like should be mounted so as to be disposed adjacent the lower or bottom end of the perforated drum so as to break the vacuum and allow leaves held on the drum to be released.

A take-off conveyor 34 is disposed immediately below the rotary screen conveyor 20 so as to intersect the longitudinal axis of the conveyance path defined thereby. In FIG. 2, the take-off conveyer 34 is disposed in a horizontal plane and is disposed substantially perpendicular to the conveyance paths of both the high speed conveyor 18 and the rotary screen 22.

As shown in FIG. 2, a baffle 32 may be provided adjacent and immediately above bottommost roller 26 to further block the air flow at the bottom of the rotary screen 22 to facilitate and/or control the rate and timing of the release of the leaves from the screen 22. The baffle 32 can be secured to support structures (not shown) on either side of the rotary screen 22 so that the baffle 32 is fixed relative to the screen 22.

As the leaves reach the bottom of the rotary screen 22 and begin to be released therefrom at least due to the obstruction of the suction air by the bottommost roller 26, a portion of each leaf comes into contact with the take-off conveyor 34 and is pulled by frictional engagement therewith in the direction of travel of the take-off conveyor. As the bottom portion of the leaf is being pulled by the take-off conveyor 34, the upper portion of the leaf may be still drawn against the rotary screen 22 by the air current therethrough. This interaction causes the leaf to be laid essentially lengthwise on the take-off conveyor 34 as it is released from the rotary screen 22 so that the leaf will be oriented with its stem portion substantially parallel to the direction of conveyance of the take-off conveyor.

The take-off conveyor 34 can be in the form of a belt or a roller conveyor. In the alternative or additionally, the belt may be perforated or of an open-mesh construction to allow air flow therethrough, as described more particularly below with reference to FIG. 3.

The take-off conveyor is preferably of variable speed so that the depth of leaves falling onto the conveyor from the rotary screen can be controlled to an optimum thickness for the following processing step. Preferably the feed of the take-off conveyor is selected so that the thickness of leaves is fairly shallow if the leaves are subsequently processed to remove lamina from or strip individual leaves. If, on the other hand, the leaves are to be cut to provide "Bird's Eyes", sometimes called a shag cut, a greater depth of leaves on the take-off conveyor would be preferred. In addition, the linear velocity of the take-off conveyor should be at least as fast and preferably faster than the velocity of the rotary screen so that the take-off conveyor tends to pull on and stretch the leaf as it is being released from the rotary screen.

Guide plates or the like 36, shown by way of example on either side of the take-off conveyor 34 and in the vicinity of the rotary screen 22, can be provided to assist the lengthwise orientation of the individual tobacco leaves. Further, such guide plates may be provided downstream from the rotary screen 22 on the take-off conveyor 34 to facilitate the proper positioning of the tobacco leaves on a particular portion of the take-off conveyor and parallel to the direction of conveyance to facilitate further processing.

Figure 3:
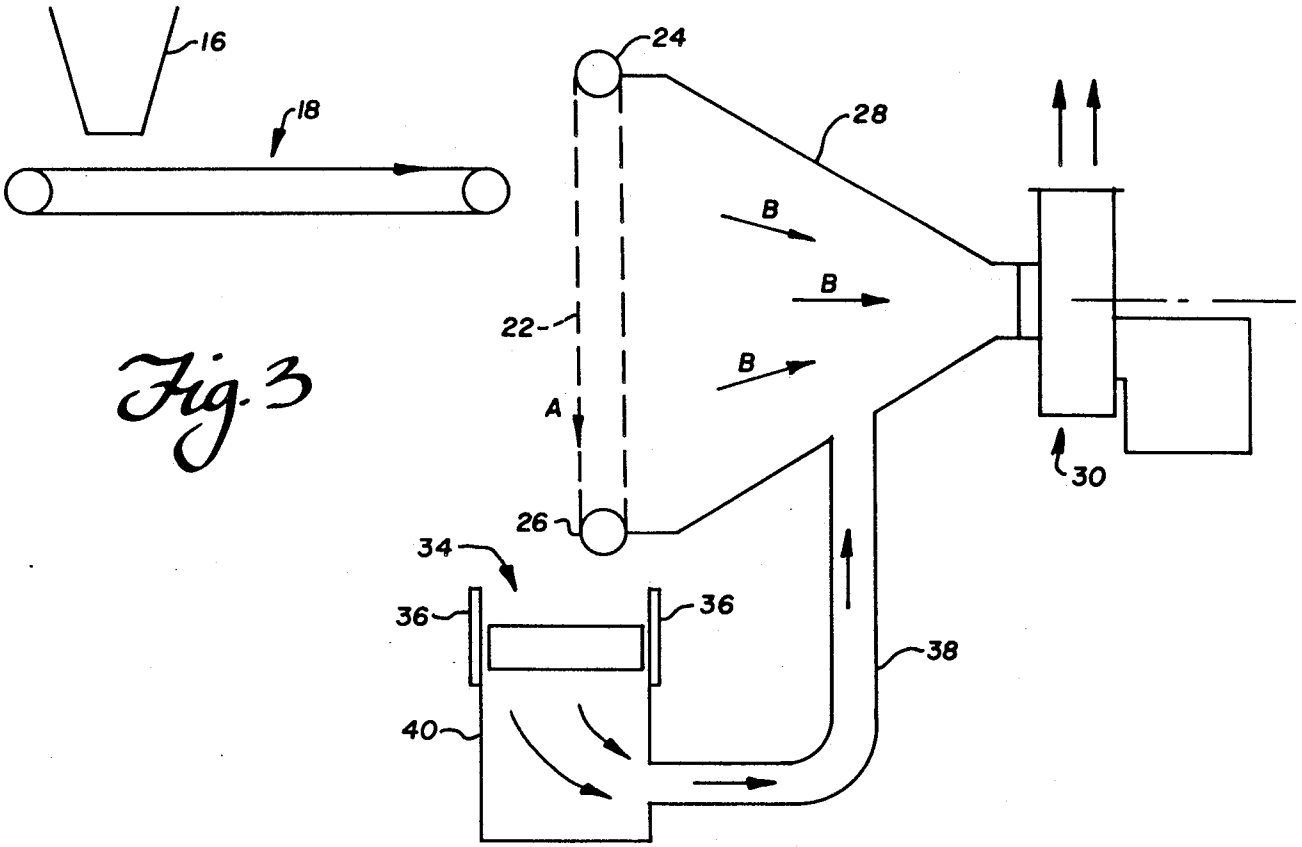
FIG. 3 is a schematic side elevational view of an alternate embodiment of the invention.

Referring to FIG. 3, an embodiment of the invention is shown which is substantially similar to that of FIG. 2. However, in this embodiment, the take-off conveyor 34 is a perforated belt or open mesh construction such as for example a loosely woven material or slotted stainless steel mesh. Further, an auxiliary duct 38 extends from the plenum chamber 28 to a suction chamber 40 defined immediately below the take-off conveyor 34. Accordingly, a portion of the exhaust air of the plenum chamber 28 is drawn through the take-off conveyor 34 to draw the tobacco leaves to the conveyor as they are being released from the rotary screen 22. Such positive drawing of the tobacco leaves to the take-off conveyor facilitates the lengthwise orientation of the same. In addition, the suction chamber 40 can be compartmentalized with, for example, baffle plates (not shown) so that the suction is limited to particular portions of the take-off conveyor 34. Thus for example suction lanes could be defined along the take-off conveyor 34 to hold the tobacco leaves on particular portions of the take-off conveyor 34. As another alternative, the take-off conveyor 34 can be perforated in lanes rather than partitioning the suction chamber 40 to effect such leaf position control.

A further advantage of both the rotary screen 22 of the invention and the open mesh take-off conveyor 34 shown in FIG. 3 is that the exhaust air accomplishes a cleaning function by removing tobacco fines, dust and dirt from the tobacco leaves. The exhausted air leaving the blower 30 can be cleaned, for example with dust collectors (not shown) and then the tobacco fines can be recovered for further processing, if desired.

In this regard, fines, dust, dirt and the like may become entrained within rotary screen 22 and can disadvantageously interfere with the bottom roller 26. In accordance with the present invention, then, a means for removing fines and the like from above the bottommost roller 26, shown generally at 88, is provided. In the illustrated embodiment, a tube 90 is mounted within rotary screen 22 so that its longitudinal axis is parallel to the longitudinal axis of the bottommost roller 26. Further, a longitudinal slit is defined along the upper surface of the tube 90. Converging plates 92 are mounted vertically above tube 90 and direct fines and the like toward and into tube 90 through the slit. A transverse tube portion 94 is further provided and extends, for example into plenum chamber 28. Thus the exhaust blower 30 will draw air through tube portion 94 and tube 90 to draw fines and the like trapped in rotary screen 22 and which tend to settle on the bottommost roller 26 into plenum chamber 28. While tube 90 and tube portion 94 have been shown as illustrative of a suitable removal system for tobacco fines, dust and the like, it is to be understood that other means could be provided for performing this function without departing from this invention.

Figure 4:
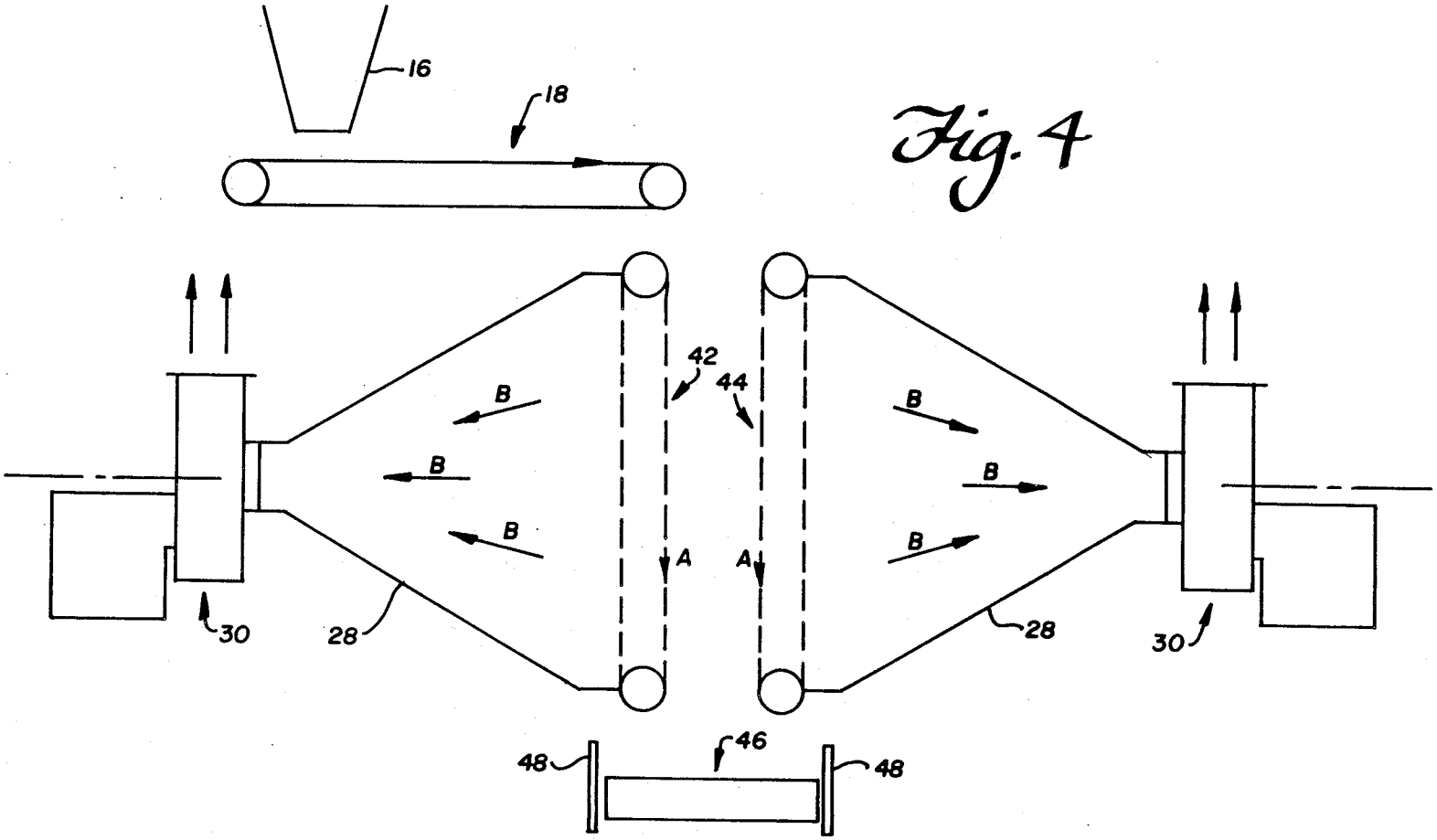
FIG. 4 is a schematic side elevational view of yet another embodiment of the present invention.

Referring to FIG. 4, first and second opposed rotary screens 42, 44 can be provided in accordance with the present invention above a single take-off conveyor 46 for receiving tobacco leaves from a single high speed conveyor 18. In this embodiment, the leaves delivered by conveyor 18 are drawn to one or the other of the rotary screens 42, 44 in a manner analogous to the embodiments of FIGS. 2 and 3. However, because two rotary screens are provided for receiving the tobacco leaves, the throughput of the apparatus can be increased and further separation of leaves can be facilitated. In addition, a wider take-off conveyor 46 may be provided so that the rotary screens deliver oriented tobacco leaves to first and second portions of the take-off conveyor. Guide plates 48 may also be provided on either side of and/or vertically above the take-off conveyor to facilitate orientation of the leaves in a lengthwise direction and to direct the tobacco leaves to a particular portion of the conveyor belt for further processing. Thus, the tobacco being received by the take-off conveyor can be oriented lengthwise into parallel rows or possibly in a single but deeper row depending upon the spacing of the rotary screens and the disposition of the guide plates 48. For example, if the screens are angled or toed inward at the bottom, both screens could discharge into one lane of tobacco leaves.

With the rotary screen configurations shown in FIGS. 2–4, if an excess of tobacco leaves is fed to the rotary screen(s), only the leaves contacted in the screen(s) will be adhered thereto by the air flow. Therefore, excess leaves which do not adhere to the rotary screen will fall freely to the take-off conveyor in a random orientation.

Figure 5:
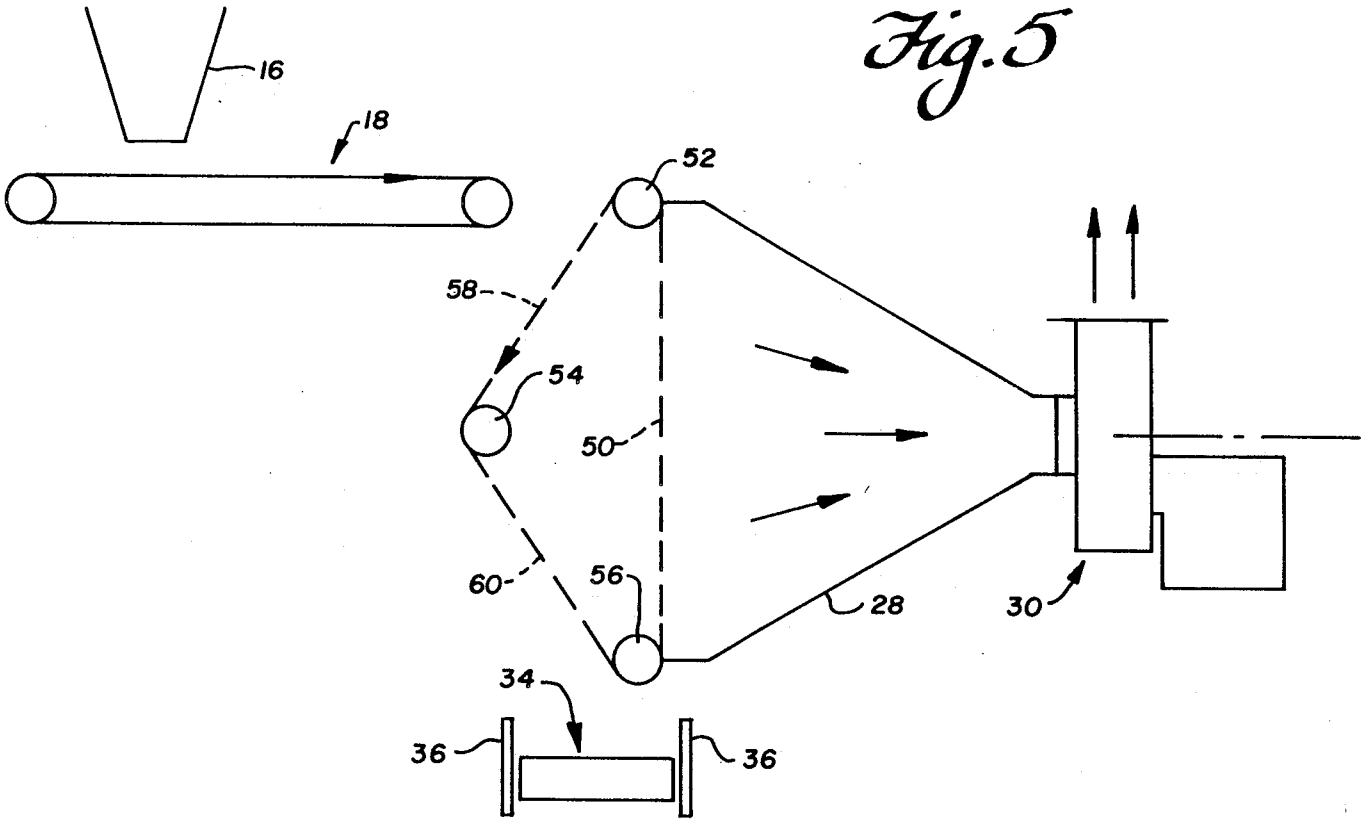
FIG. 5 is a schematic side elevational view of yet a further alternate embodiment of the present invention.

To minimize the likelihood of leaves being received by the take-off conveyor in an orientation other than the desired lengthwise orientation, a three-roller configuration can be provided as shown in FIG. 5. In this embodiment, the rotary screen 50 travels over three rollers 52, 54, 56 mounted in a triangular configuration so that the top of the front portion 58 of the rotary screen 50 is angled upwardly and the bottom portion 60 is angled downwardly. Thus, any excess leaves not drawn to the rotary screen will fall off as they pass the left-most roller 54. A receptacle or separate conveyor (not shown) for recirculation back to the high speed belt 18 can be provided for receiving the excess leaves. Those leaves which adhere to the rotary screen continue around the left-most open type roller 54 and are released onto the take-off conveyor 34 in an oriented manner as was the case with the structures of FIGS. 2–4. In this embodiment, in order to ensure that leaves are held on the conveyor belt when passing over left-most roller 54, it is preferred that roller 54 be perforated or be in the form of a shaft with a plurality of longitudinally spaced plates to ensure that suction air passes through the "roller" 54 and thus reaches the rotary screen 50 and the leaves disposed thereon.

Figure 6:
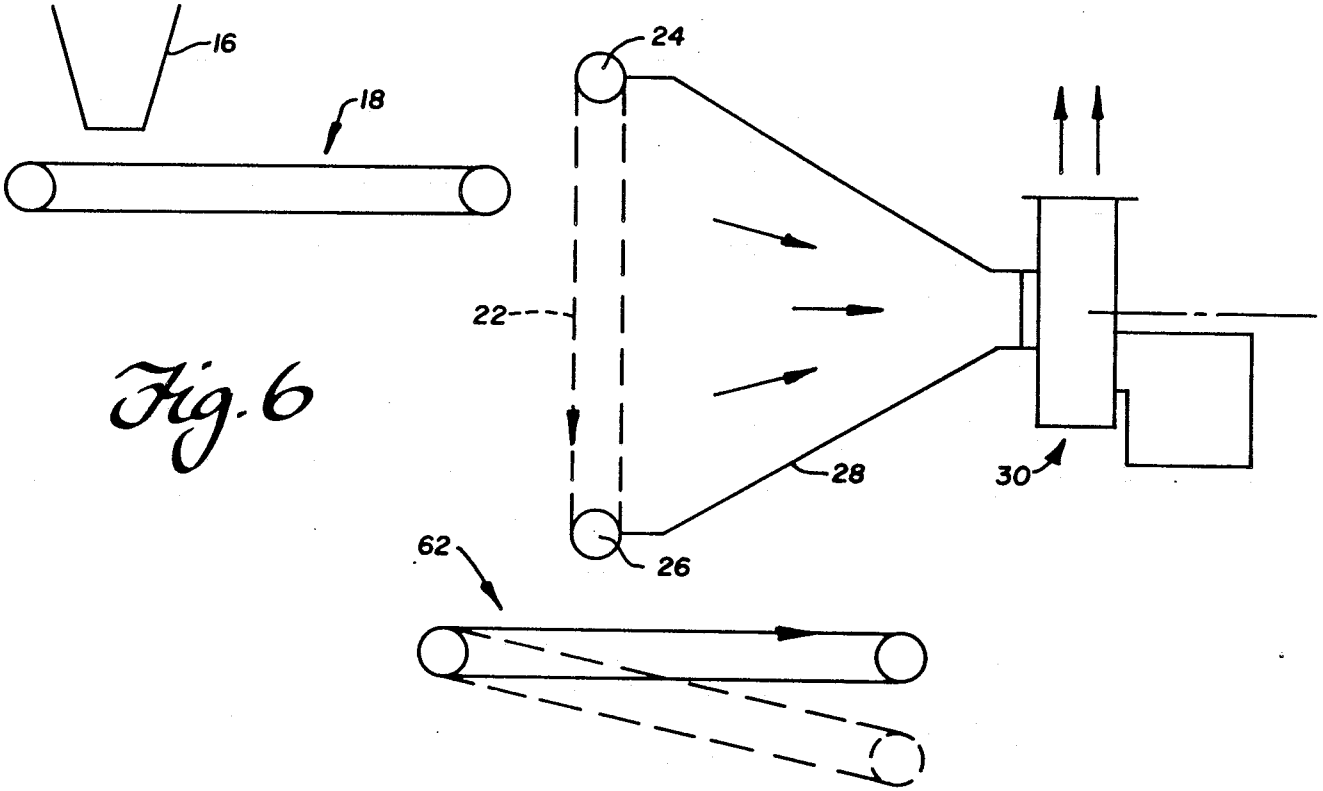
FIG. 6 is a schematic side elevational view of a further embodiment of the present invention.

FIG. 6 is schematic elevational view substantially similar to the view of FIG. 2 but wherein the take-off conveyor 62 is disposed to run substantially parallel to the high speed conveyor 18 and perpendicular to the longitudinal axis of the rotary screen 22. When the take-off conveyor is disposed in this orientation, as the leaves are released from the bottom portion of the rotary screen 22, they are drawn to the right. Of course, the particular orientation of the take-off conveyor relative to the conveying directions of the high speed conveyor 18 and the rotary screen 22 can be varied to take off the leaves in any desired direction including at an angle to horizontal (as shown in phantom lines) depending upon the particular tobacco processing system in which the conveyor system is employed. Indeed, the orientation of the take-off conveyor relative to the rotary screen merely determines in what direction the tobacco leaves will be conveyed and does not influence the ability of the system to orient the tobacco leaves substantially parallel to the direction of travel of the take-off conveyor as long as the leaves tend to be pulled by the take-off conveyor.

Figure 7:
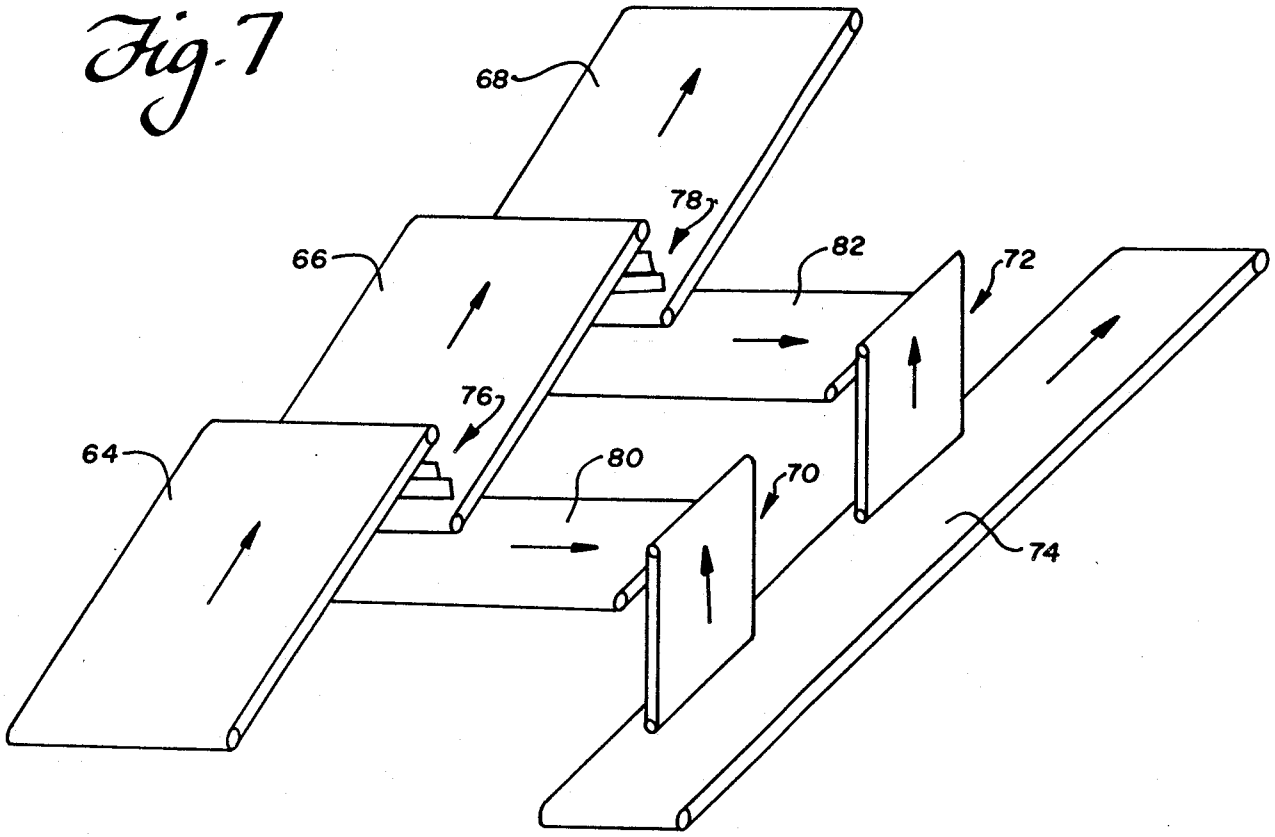
FIG. 7 is a schematic perspective view of a pneumatic leaf orienting system embodying the present invention.

Referring now to FIG. 7, a series of inclined conveyors 64, 66, 68 can be provided to divide up the tobacco feed between two or more series arranged pneumatic alignment devices 70, 72 (shown without the associated plenum chambers for clarity) which convey tobacco to a single take-off conveyor 74. As can be seen, rotating rollers, paddles or the like 76, 78 are mounted intermediate the adjacent inclined conveyors 64–68. The rollers or paddles 76, 78 shown rotate about their axes in a counter-clockwise direction, skimming proportionately from total capacity to desired capacity for each conveyor so as to direct the tobacco to the high speed conveyors 80, 82. The high speed conveyors 80, 82 deliver the tobacco leaves to rotary screens 70, 72, respectively, which in turn orient the leaves on the take-off conveyor 74 in a manner analogous to the embodiment shown in FIG. 2. With such a structure, a deeper layer of oriented leaves is provided on the take-off conveyor 74. Such a thicker layer of oriented leaves is desired for some types of further processing and can be held down during the cutting operation by rollers or the like (not shown). In the alternative, the screens could be offset from one another, widthwise of the take-off conveyor to yield multiple lanes of tobacco leaves.

Referring again to FIG. 1, after the tobacco leaves have been longitudinally oriented with the pneumatic apparatus 14 of the present invention they are subjected to further processing, identified as box 84 in FIG. 1, wherein the lamina is cut away from the stem portion so that only a portion of the tobacco leaf need be subjected to threshing and classifying, as at 86, or wherein the lamina is removed so that no threshing and classifying is necessary.

More particularly, the oriented leaves may be run through parallel slitters which are oriented parallel to the main stem on the conveyor so as to cut the lamina away from both sides of the main stem portion so that only the main stem portion with a majority of the lamina cut away need be sent to the threshing operation 86.

In the alternative, the oriented leaves may be run through a single slitter oriented perpendicular to the longitudinal direction of the main stem. In this manner, the upper one third or tip portion of the leaf which contains acceptable stem may be cut-away from the butt portion of the leaf which includes the objectionable stem portion so that only the butt stem portion need be sent to the threshing and classifying operation 86.

Finally, the oriented leaves may be run through guillotine type cutters oriented perpendicular to the longitudinal direction of the main stem to make multiple cuts therethrough. As noted above, such "shag" cutting is used when it is desired to retain a small segment of the stem by cutting across the width of the leaf. Shag cut tobacco is used, for example, for roll-your-own cigarettes and some pipe tobacco.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. An apparatus for orienting articles so as to be disposed parallel to a direction of conveyance, comprising:

first roller means;

second roller means mounted vertically below said first roller means;

a conveyor belt element mounted to and extending between said first and second roller means to define therewith a main conveyance path, said main conveyance path having a front side and a back side;

means for generating an air current through at least a portion of said main conveyance path from said front side to said back side so that articles projected towards said front side of said main conveyance path are held thereagainst by said air current;

means for driving at least one of said conveyor belt element, said first roller means, and said second roller means so that articles are conveyed on said front side of said main conveyance path in a direction from said first roller means toward said second roller means; and continuously driven take-off conveyance means defining a take-off conveyance path vertically below said second roller so as to intersect a vertical plane defined through said first and second roller means for receiving articles from said main conveyance path and for orienting at least articles having their longitudinal axes disposed substantially parallel to a direction of conveyance of said main conveyance path substantially parallel to a direction of conveyance of said take-off conveyance path.

2. An apparatus as in claim 1, further comprising means for driving said take-off conveyance mean at a linear velocity greater than a linear velocity at which articles are conveyed on said main conveyance path.

3. An apparatus as in claim 1, wherein said conveyor belt element is a metal screen.

4. An apparatus as in claim 1, wherein said conveyor belt element is formed from a perforated material.

5. An apparatus as in claim 1, further comprising first means for conveying articles to be oriented to said main conveyance path.

6. An apparatus as in claim 5, wherein said first means for conveying articles comprises means defining a first conveyance path terminating adjacent an upper end of said main conveyance path.

7. An apparatus as in claim 6, wherein said first means for conveying articles comprises a first conveyor belt element and means for driving said first conveyor belt element to convey articles to said main conveyance path.

8. An apparatus as in claim 1, further comprising guide plate elements mounted vertically above said take-off conveyance path for guiding articles to a predetermined portion of said take-off conveyance path.

9. An apparatus as in claim 1, further comprising a baffle element mounted so as to be disposed immediately adjacent and vertically above said second roller means for blocking a portion of the air flow through said main conveyance path.

10. An apparatus as in claim 1, further comprising third roller means mounted intermediate said first and second roller means and laterally offset therefrom so that said first, second and third roller means define a triangle, said conveyor belt element extending from said first roller means to said third roller means and then to said second roller means so as to define first and second angularly disposed main conveyance paths, one defined between said first and third roller means and one defined between said third and second roller means.

11. An apparatus as in claim 1, wherein said means for generating an air current comprises means defining a plenum chamber adjacent said back side of said main conveyance path and an exhaust blower for drawing air through said plenum chamber.

12. An apparatus as in claim 11, wherein said take-off conveyance path is defined by a take-off conveyor belt element and means for driving said take-off conveyor belt element.

13. An apparatus as in claim 12, further comprising means defining a suction chamber vertically below said take-off conveyor belt element and means defining an auxiliary air passage between said suction chamber and said plenum chamber, whereby a current of air is generated through said take-off conveyor belt element from a top side thereof to a bottom side thereof.

14. An apparatus as in claim 1, wherein said take-off conveyance path is defined in a horizontal plane.

15. An apparatus as in claim 1, wherein said take-off conveyance path is defined at an angle to horizontal.

16. An apparatus as in claim 6, wherein the direction of conveyance of said take-off conveyance path is substantially parallel to a direction of conveyance of said first conveyance path.

17. An apparatus as in claim 6, wherein said first conveyance path is defined in a horizontal plane.

18. An apparatus as in claim 6, further comprising means for delivering articles to be oriented to said first conveyance path.

19. An apparatus as in claim 18, wherein said means for delivering comprising means defining at least one inclined conveyance path and means for directing articles from a said inclined conveyance path to an upper surface of said first conveyance path.

20. An apparatus as in claim 18, wherein said means for delivering comprises a chute element mounted vertically above said first conveyance path.

21. An apparatus for orienting articles comprising:

means defining a first conveyance path having a first end and a second end for conveying articles from said first end toward said second end;

means defining a second conveyance path having a first end and a second end, said first and second ends being defined in a substantially vertical plane, for conveying articles from said first end to said second end, said second conveyance path having a front side and a back side, said articles being conveyed on said front side, said first and second conveyance paths being mounted so that said second conveyance path receives articles to be oriented from said second end of said first conveyance path;

means for generating an air current through at least a portion of said second conveyance path from said front side to said back side so that articles projected towards said front side of said second conveyance path are held thereagainst by said air current; and means defining a continuously driven third conveyance path vertically below said second conveyance path so as to intersect a vertical plane defined through said first and second ends of said second conveyance path for receiving articles from said second conveyance path, whereby, articles received by said third conveyance path from said second conveyance path are oriented so as to be disposed substantially parallel to a direction of conveyance of said third conveyance path.

22. An apparatus as in claim 21, further comprising means for driving said third conveyance path at a linear velocity greater than a linear velocity at which articles are conveyed on said second conveyance path.

23. An apparatus as in claim 21, wherein said second conveyance path includes a belt formed from a perforated material.

24. An apparatus as in claim 21, further comprising a baffle element mounted so as to be disposed behind said front side of said second conveyance path immediately adjacent said second end thereof for blocking a portion of the air flow through said second conveyance path.

25. An apparatus as in claim 21, wherein said means for generating an air current comprises means defining a plenum chamber adjacent said back side of said main conveyance path and an exhaust blower for drawing air through said plenum chamber.

26. An apparatus as in claim 25, wherein said third conveyance path is defined by a take-off conveyor belt element and means for driving said take-off conveyor belt element.

27. An apparatus as in claim 26, further comprising means defining a suction chamber vertically below said take-off conveyor belt element and means defining an auxiliary air passage between said suction chamber and said plenum chamber, whereby a current of air is generated through said take-off conveyor belt element from a top side thereof to a bottom side thereof.

28. A method of orienting articles so as to be disposed parallel to a direction of conveyance comprising:

providing first roller means;

providing second roller means mounted vertically below said first roller means;

mounting a conveyor belt element to said first and second rollers so as to extend therebetween and to define therewith a main conveyance path having a front side and a back side;

generating an air current through at least a portion of said main conveyance path from said front side to said back side;

driving at least one of said conveyor belt element, said first roller means, and said second roller means so that articles are conveyed on said front side of said main conveyance path in a direction from said first roller means toward said second roller means;

delivering articles to be oriented to said main conveyance path intermediate said first roller means and said second roller means; and providing a continuously driven take-off conveyance means defining a take-off conveyance path vertically below said second roller so as to intersect a vertical plane defined through said first and second roller means for receiving articles from said main conveyance path;

whereby articles to be oriented which are directed toward said main conveyance path are adhered thereto under the influence of said air current, said articles to be oriented being transferred to said take-off conveyance means so that said articles are oriented substantially parallel to a direction of conveyance of said take-off conveyance means.

29. A method as in claim 28, further comprising the step of driving said take-off conveyance means at a linear velocity greater than a linear velocity at which articles are conveyed on said main conveyance path.

30. A method as in claim 28, further comprising the step of generating an air current through said take-off conveyance path from an upper surface thereof to a lower surface thereof.

31. A method for orienting articles comprising:

providing a first conveyance path having a first end and a second end;

providing a second conveyance path having a first end and a second end, said first and second ends being defined in a substantially vertical plane, said second conveyance path having a front side and a back side;

mounting said first and second conveyance paths so that articles to be oriented are delivered from said first conveyance path to an upper end of said second conveyance path;

conveying articles to be oriented along said first conveyance path;

delivering said articles to be oriented from said first conveyance path to said second conveyance path;

conveying said articles to be oriented along said second conveyance path;

generating an air current through at least a portion of said second conveyance path from said front side to said back side so that articles delivered to said front side of said second conveyance path from said first conveyance path are held thereagainst by said air current; and providing a continuously driven third conveyance path vertically below said second conveyance path so as to intersect a vertical plane defined through said second conveyance path for receiving articles from a lower end of said second conveyance path; and conveying articles on said third conveyance path, whereby, articles received by said third conveyance path from said second conveyance path are oriented so as to be disposed substantially parallel to a direction of conveyance of said third conveyance path.

32. An apparatus as in claim 31, further comprising the step of driving said third conveyance path at a linear velocity greater than a linear velocity at which articles are conveyed on said second conveyance path.

33. A method as in claim 31, further comprising the step of generating an air current through said third conveyance path from an upper surface thereof to a lower surface thereof.

* * * * *